United States Patent [19]

Scherz

[11] Patent Number: 4,867,129

[45] Date of Patent: Sep. 19, 1989

[54] MACHINED ARCHER'S REST

[76] Inventor: Patrick L. Scherz, 1632 18 ½ St., Rice Lake, Wis. 54868

[21] Appl. No.: 283,667

[22] Filed: Dec. 13, 1988

[51] Int. Cl.[4] ..... F41B 5/00

[52] U.S. Cl. ..... 124/41 A

[58] Field of Search ..... 124/41 A, 41 R, 24 R, 124/86, 88

[56] References Cited

U.S. PATENT DOCUMENTS

| | | | |
|---|---|---|---|
| 3,292,607 | 12/1966 | Hoyt | 124/41 A |
| 3,482,563 | 12/1969 | Pint | 124/24 R |
| 3,865,096 | 2/1975 | Troncoso | 124/24 R |
| 4,119,078 | 10/1978 | Wilson et al. | 124/41 A |
| 4,170,980 | 10/1979 | Killian | 124/41 A |
| 4,548,188 | 10/1985 | Simo | 124/41 A |
| 4,715,355 | 12/1987 | Lattig | 124/41 A |
| 4,732,135 | 3/1988 | Simo | 124/41 A |
| 4,809,670 | 3/1989 | Simo | 124/41 A |

*Primary Examiner*—Randolph A. Reese
*Assistant Examiner*—John A. Ricci
*Attorney, Agent, or Firm*—Carl E. Gulbrandsen; James A. Gabala

[57] ABSTRACT

An archer's rest comprising a base member having an axial bore, a compressive spring located within the bore, a plunger slidingly captured in the bore to have one end positioned against the spring and a free end, a screw for adjusting the force exerted by the spring on the plunger, a wire rest made from one length of spring wire to have a straight section which is joined to a first spring section which is joined to a spacer section which is generally at right angles to the straight section and which is joined to a second spring section which has a free end which is adapted to support the shaft of an arrow, and a fastener for removably attaching the wire rest to the plunger and for adjusting the free end of the spring section relative to the free end of the plunger.

27 Claims, 3 Drawing Sheets

FIG. 1
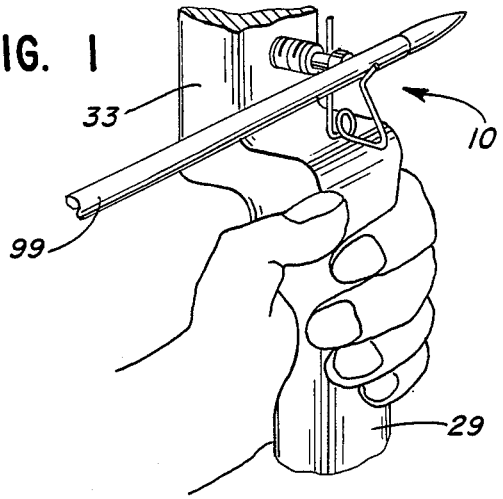
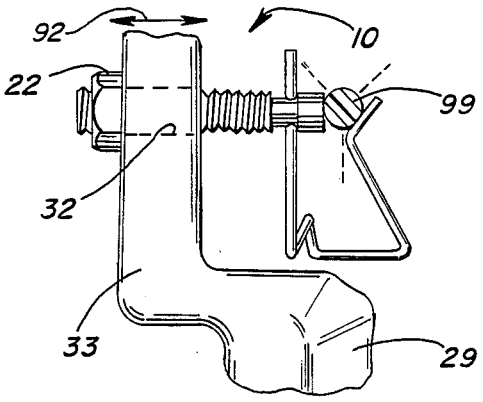
FIG. 2A
FIG. 3
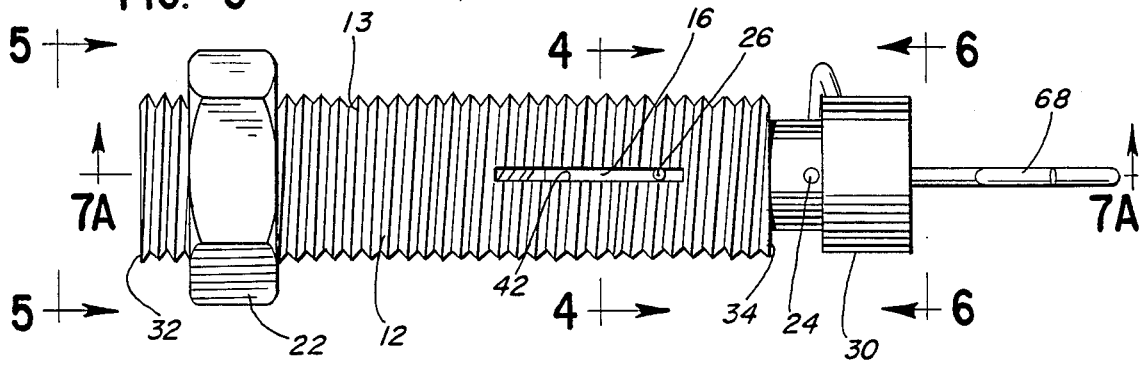
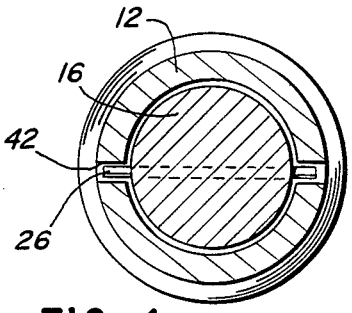
FIG. 4
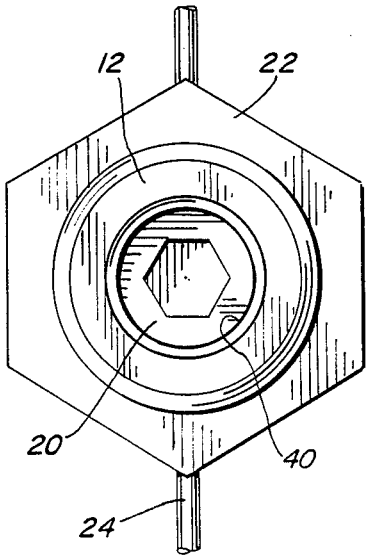
FIG. 5
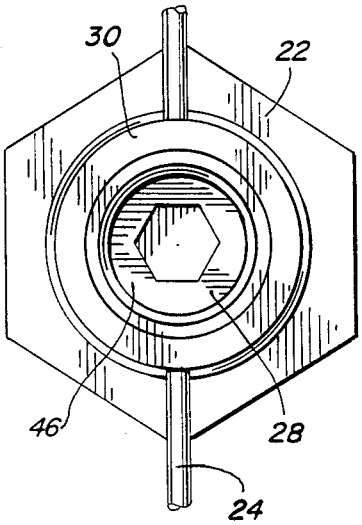
FIG. 6

FIG. 7A
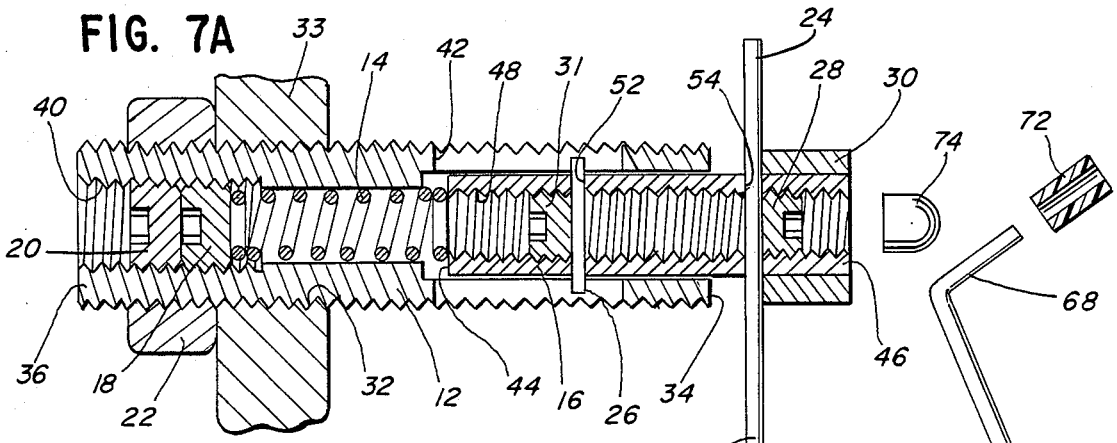
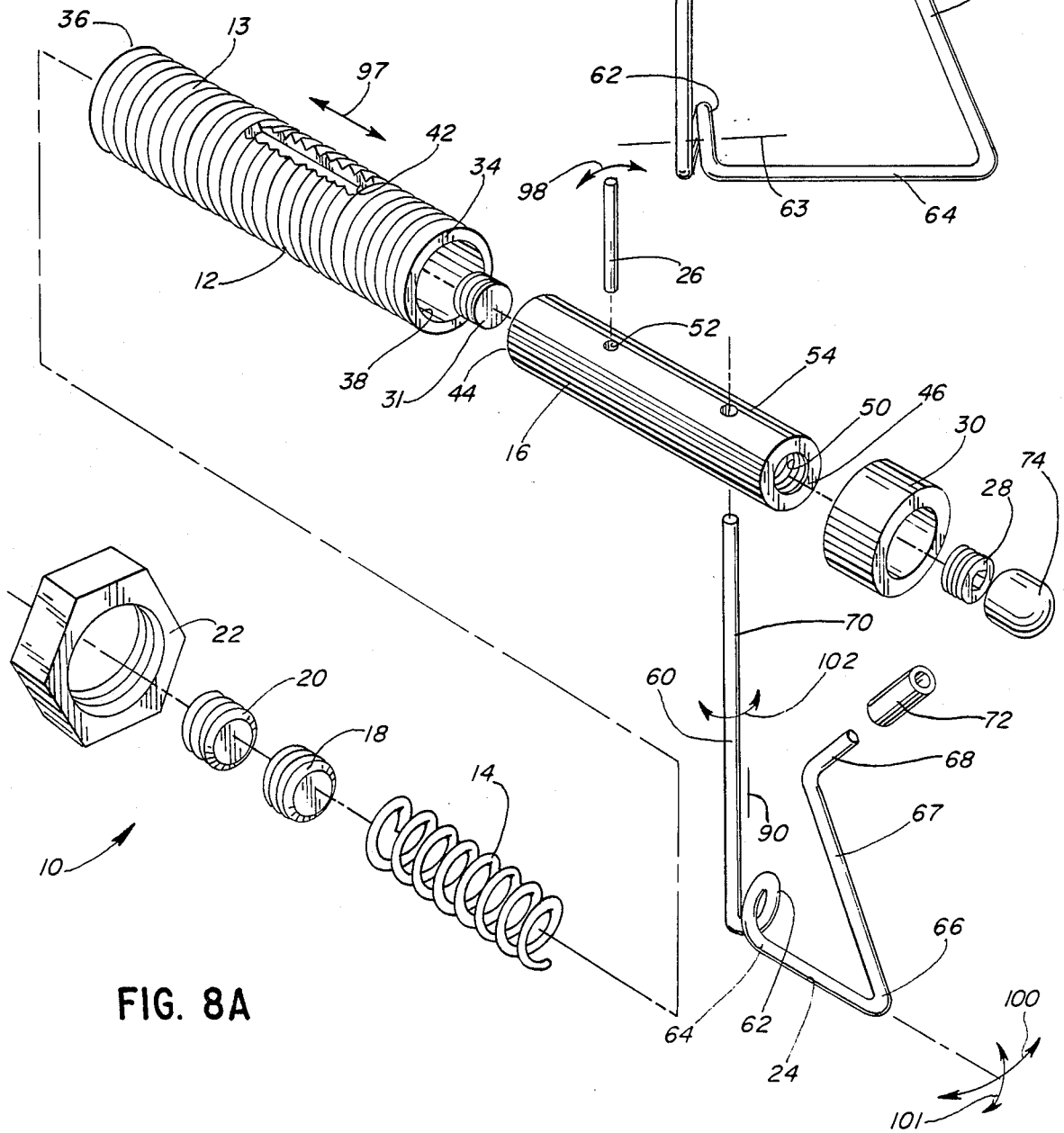
FIG. 8A

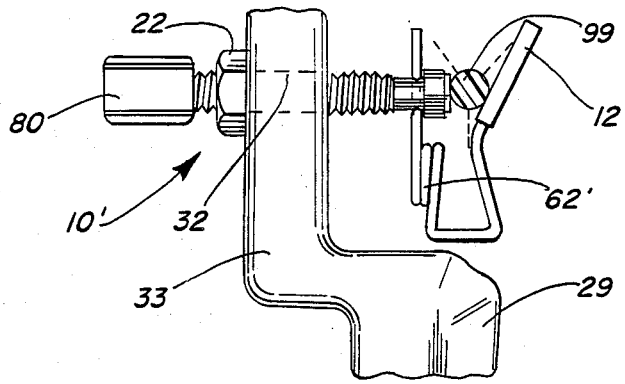
FIG. 2B
FIG. 7B
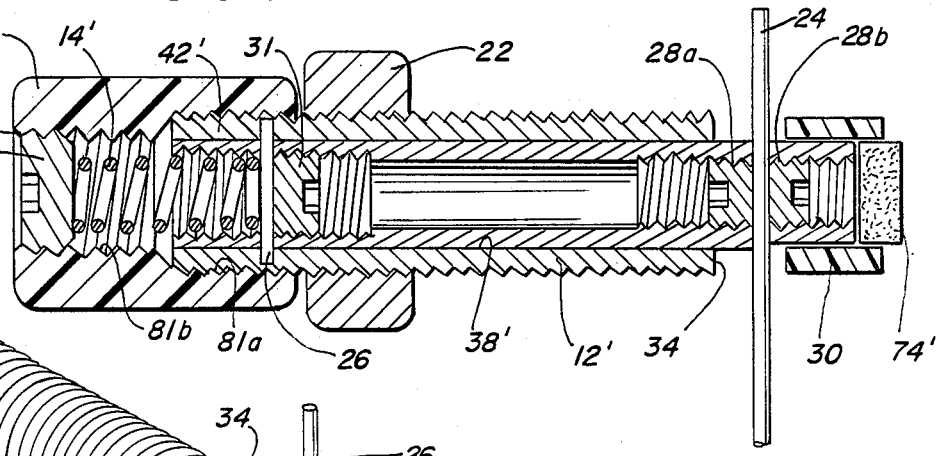
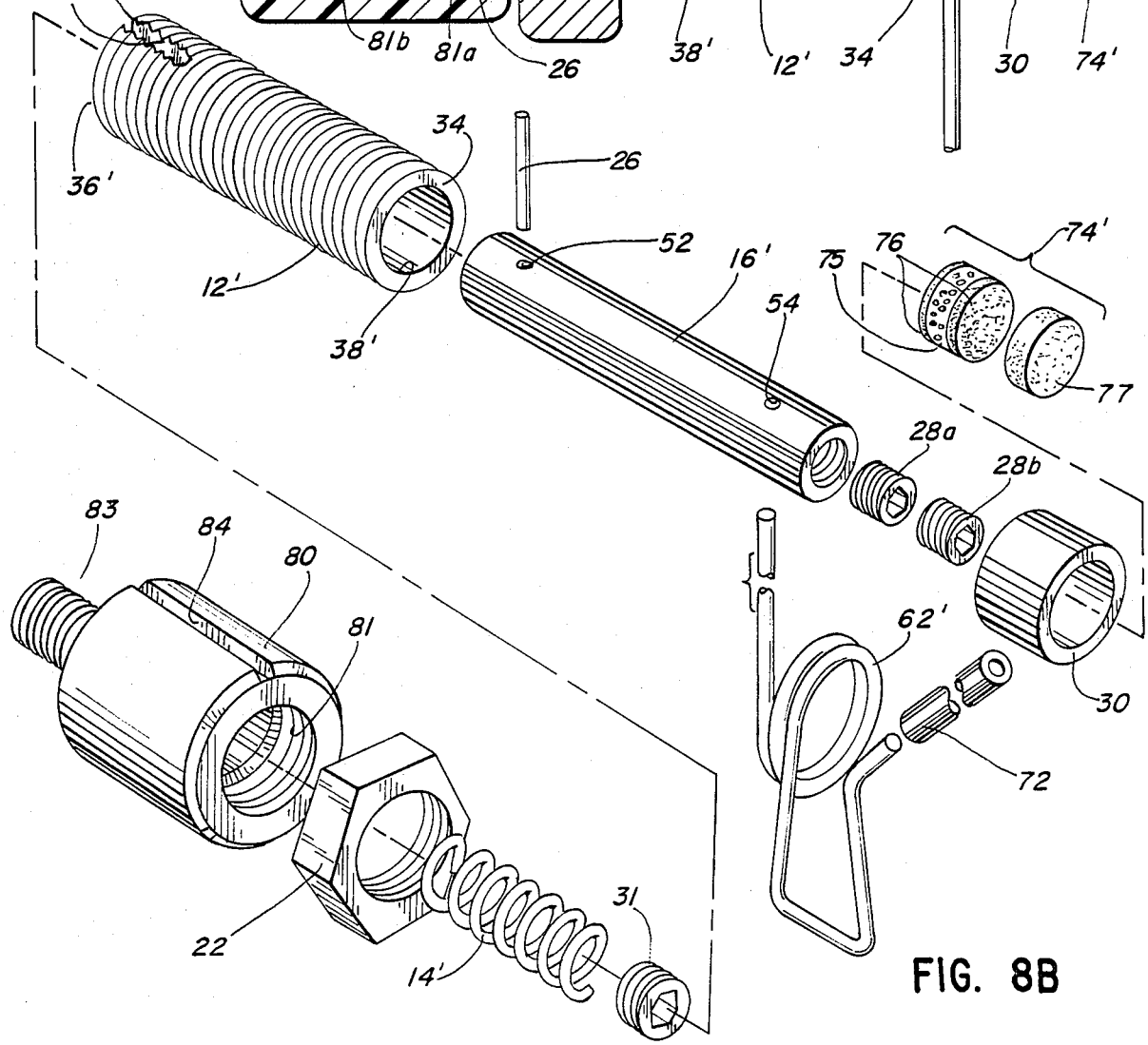
FIG. 8B

MACHINED ARCHER'S REST

TECHNICAL FIELD

This invention relates to the general subject matter of archery and, in particular, to arrow rests and the like.

BACKGROUND OF THE INVENTION

Archers know the value of mechanical devices to increase the enjoyment of the sport. Arrow rests are devices which are used to stabilize arrow position preparatory to arrow release by supporting the forward portion of an arrow.

U.S. Pat. Nos. 3,482,563 to Pint; 4,170,980 to Killian; and 4,215,666 to Carroll et al, describe a fixed arrow rest used with an adjustable spring loaded plunger which is mounted on a bow handle to clear the fletched end of the arrow from the bow handle and thereby improve accuracy. Pressure plates or cushion plungers absorb some of the arrow shaft side bending forces (i.e., archers paradox) which are encountered during arrow shooting. U.S. Pat. No. 3,865,096 to Troncosco describes a single leaf-like spring arrow rest in combination with a separately movable adjustable plunger to cushion lateral thrust when the arrow is released. In U.S. Pat. Nos. 3,918,428 and 4,119,078 to Wilson et al, and U.S. Pat. Nos. 4,592,332 and 4,686,956 to Topping, a leaf-like spring arrow rest is attached to a spring-loaded plunger. In U.S. Pat. No. 4,299,195 to Norris, a fixed coil spring is used as an arrow rest to dampen the oscillations of an arrow set in flight. In U.S. Pat. No. 4,548,188 to Simo, a laterally adjustable arrow rest is disclosed wherein a pivotable wire arrow support arm is provided at the end of an adjustable spring loaded plunger.

It is clear from the state-of-the-art that a satisfactory archer's rest has not been found. In particular, the problem of providing adequate clearance to avoid feather or vane wear has yet to be resolved. Moreover, a rest has not been disclosed which is easy to adjust, easy to manufacture, and which has improved, un-impeded, smooth arrow flight, greater speed, and better shooting accuracy, especially for light weight arrows. Such a rest should be able to take arrow forces in a wide variety of directions, and should be readily adjustable in position in the bow window to accommodate various bows, arrow shapes, arrow weights, and fletchings.

SUMMARY OF THE INVENTION

In accordance with the present invention, an improved archer's rest is disclosed comprising a base member, a plunger member which is slidingly captured in a bore within the base member and biased to have a free end extending out of the base member in the direction of the arrow shaft, an adjusting means carried by the base member for adjusting the amount of bias supplied to the plunger, a wire rest having a relatively long straight section which is joined to a first spring section which is joined to a relatively short spacer section which is generally at right angles to the straight section and which is joined to a second spring section which has a free end which is adapted to support the arrow shaft, second adjusting means carried by the plunger member for removably attaching the wire rest to the plunger member and for adjusting the separation of the free end of the spring section from the free end of the plunger, and means for limiting the axial travel and rotation of the plunger member relative to the base member.

In one particular embodiment the wire rest passes through a bore in the plunger, has the first spring section in the form of a single coil spring, such that the axis of the coil is generally at right angles to the straight section, and has a second spring member in the form of a cantilevered dog-leg shaped arm which is generally in the same plane as the straight section and the spacer section. In one embodiment of the invention, a nylon-like ring is provided at the free end of the plunger member to reduce friction between the arrow and plunger member, a leather insert is carried by the free end of the plunger member, and a plastic sleeve is added to the free end of the wire rest.

Although the invention is especially useful for release shooters, it has been found to work quite well for finger shooters. Moreover, it has demonstrated surprisingly good performance with light weight arrows. These and other advantages of the present invention will become apparent from the drawings, the description, and the claims which follow.

BRIEF DESCRIPTION OF THE DRAWINGS

FIG. 1 is a pictorial representation of one embodiment of the invention installed in the side wall of the handle of an archer's bow;

FIGS. 2A and 2B are partial elevational views of two embodiments of the invention, as viewed from ahead of a drawn bow string;

FIG. 3 is a top view of the invention of FIG. 1, removed from the bow handle;

FIG. 4 is a cross-sectional end view of the invention of FIG. 3, as viewed along line 4—4;

FIG. 5 is a cross-sectional end view of the invention of FIG. 3, as viewed along line 5—5;

FIG. 6 is a cross-sectional end view of the invention of FIG. 3, as viewed along line 6—6;

FIGS. 7A and 7B are cross-sectional side views of the embodiments of FIGS. 2A and 2B; and FIGS. 8A and 8B are exploded assembly drawings of the parts of the invention shown in FIGS. 2A and 2B.

DETAILED DESCRIPTION OF THE INVENTION

While this invention is susceptible of embodiment in many different forms, there is shown in the drawings, and will herein be described in detail, preferred embodiments of the invention. It should be understood however, that the present disclosure is to be considered an exemplification of the principles of the invention and is not intended to limit the invention to the specific embodiments illustrated.

Components

Turning first to FIG. 8A, the principle components of one embodiment of the invention are illustrated and the manner in which those components are joined together. Specifically, the archer's rest 10 comprises a generally cylindrical base member 12, a compressive biasing spring 14, a plunger member 16, a first threaded member 18 for adjusting the force exerted by the spring on the plunger, a second threaded member 20 for locking the first threaded member in position, a bow lock nut 22, a compound spring rest 24, a travel limit pin 26, means 28 for securing the spring rest to the plunger, a friction reducing sleeve 30, and means 31 for securing the limit pin to the plunger. In one embodiment, the base member 12 was made from brass, the spring rest 24 was made out of 0.046 inch music wire, and the bias spring 14 was made from 0.012 diameter music wire. Stainless steel is a preferred material for the spring rest.

Turning now to FIG. 3, the base member 12 comprises a generally cylindrical casing having a threaded exterior surface 13 which is adapted to be mounted in the hole 32 found in the side wall 33 of the handle of an archer's bow 29 (see FIGS. 1, 2A and 7A). The base member 12 has two opposite ends (see FIG. 8A) which define the arrow side 34 and the other side 36 of the base member. These base member 12 has an axial interior bore 38 which passes from the arrow side 34 to the other side of the base member. That end 40 of the bore 38 opposite the arrow side 34 of the base member 12 is threaded (see FIG. 7A). The base member 12 also has an slot 42 which is located intermediate the ends 34 and 36 of the base member. This slot 42 extends from the interior of the bore 38 to the exterior surface 13 of the base member 12 (see FIG. 7A).

The compressive spring or biasing member 14 is located within the interior bore 38 of the base member 12 at a location intermediate the ends 34 and 36 of the base member 12 (see FIG. 7A).

The plunger or plunger member 16 is slidingly disposed within the bore 38 of the base member 12. The plunger 16 has one end 44 which positioned against the spring 14 (see FIG. 7A). The opposite end 46, or arrow end, of the plunger 16 extends out of the arrow side or arrow end 34 of the base member 12 and, in that sense, can be considered to be the "free" end of the plunger member. The plunger member 16 has at each end 44 and 46 a threaded bore 48 and 50 (see FIG. 7A). Also, located at each end 44 and 46 of the plunger member 16 is a smooth bore 52 and 54 which is located generally at right angles to the threaded bores 48 and 50 at each end of the plunger, such that the smooth bores pass into the threaded interior of the plunger member. Preferably, one smooth bore 54 passes completely through the plunger member 16, inasmuch as it is used to carry the spring rest 24. One set screw 28 is threaded into the arrow side of the plunger bore 50 to hold the spring rest in place. Another threaded member or set screw 31 holds the travel limit pin 26 in place at the other end 44 of the plunger 16. For ease in machining, one bore can be machined completely through the plunger 16 from one end 44 to the other 46. Preferably, the accessible ends of the threaded members 18 and 20 and the pin securing means 28 and 31 are provided with recesses for receiving an allen wrench or similar tool.

The limit pin 26 is carried in the smooth bore 52 at the side 44 opposite the arrow side 46 of the plunger. The opposite ends of the limit pin fit within the slot 42 of the base member 12. Thus, the limit pin and slot determine the axial travel (see arrow 97) of the plunger and the orientation (see arrow 98) of the spring rest 24 relative to the side wall 33 of the bow.

Turning now to the compound spring rest 24 and turning to FIG. 7A in particular, the rest is made from one length of spring wire to form a straight section 60 which is joined to a first spring section 62 which joined to a spacer section 64 which is joined to a second spring section 66 which has a free end 68 which adapted to support the shaft of an arrow (see FIG. 2A).

In the embodiment shown in the drawings, the first spring section comprises a pig-tailed shaped spring or coil spring of one wrap (see FIG. 8A) or a plurality of wraps (see FIG. 8B). The axis 63 of the coil forming the first spring section 62 is generally at right angles to the straight section 60 and the longitudinal axis of the arrow. This allows the spacer section 64 to pivot about the end of the straight section or to effectively move in two mutually perpendicular planes (see arrows 100 and 101).

The upper end of the straight section may be provided with a flat side 70 which is generally opposite to the free end 68 of the rest 24. The flat side 70 provides a bearing surface for the associated set screw 28 to hold the rest 24 in position on the plunger 16. This allows one to securely attach the rest 24 to the plunger 16 and to adjust the separation (see arrow 90) of the free end 68 of the rest from the free end 46 of the plunger. Without the flat side, it is easier to rotate (see arrow 102) the straight section 60 relative to the plunger 16 and thereby vary the aspect of the free end 68 of the rest relative to the arrow.

The second spring section 66 of the spring rest 24 in the embodiment illustrated in the drawings, comprises a cantilevered arm 67 which is generally in the same plane as the straight section 60 and the spacer section 64. The free end 68 is bent outwardly, such that the cantilevered arm 66 has a dog-leg shape. The dog-leg arrangement of the second spring section 66, the right angled arrangement between the straight section 60 and the spacer section 64, and the single wrapped coil spring 62 provides more clearance for helical fletchings than that heretofore available. Those skilled in the art will recognize that the attachment of the straight section 60 to the plunger 16 puts the first spring section 62 at the end of a cantilever (i.e., the straight section is a cantilever spring). Similarly, since the second spring section 66 is at the end of the spacer section 64, it too is at the end of a cantilever spring. Thus, the free end 68 of the rest 24 is at the end of four springs which are connected in series to each other.

To reduce friction between the arrow shaft and the archer's rest 10, the free end 46 of the plunger 16 is provided with a nylon-like ring 30. Preferably, the ring 30 is made from an aluminum and nylon composition, such as that sold under the tradename Nyaltron. A plastic (e.g., Teflon) sleeve 72 may be added to the free end 68 of the spring rest 24 to quiet the launch of the arrow and protect the fletches of the arrow. Moreover, a suede leather inssert 74 may be added to the open end of the bore 50 at the arrow end of the plunger 16 to reduce the noise associated with the release of the arrow. In one embodiment (see FIG. 8B), the leather insert 74' comprises a foam base 75 having adhesive 76 at each end and a leather end pad 77 at the outer end.

Turning to FIGS. 2B, 7B and 8B, another embodiment 10' of the invention is depicted. This particular embodiment is similar to that of FIGS. 2A, 7A and 8A with some modifications. The archer's rest 10' comprises a base member 12', a biasing spring 14' and a plunger 16', located in the base member. Here the end of the internal bore 38' of the base member 12', that is located opposite the arrow side 34 of the base member, is not threaded. Moreover, the axial slot 42' has one end 43' which is open. An internally threaded plastic (e.g., DELRIN) cap 80 is threadably joined to the slotted end 36' of the base member 12'. The cap 80 has a threaded counterbore 81*a* and 81*b* and a centered opened 82. A set screw 83 is threadably connected to the interior of the cap 80 for adjusting the compression of the spring 14'. Thus when the spring 14' is positioned between the cap 80 and the plunger 16' and the cap is joined to the base member 12', the spring biases the plunger in the direction of the arrow 99. One advantage of this embodiment is that, by twisting the cap 80 with one's fingers, the spring force can be adjusted without having to use small wrenches or tools. This is an especially useful feature when the archer is "in the field" or when allen wrenches, to adjust the set screws 18 and 20 of the previous embodiment, are not available or are difficult to manipulate. To facilitating gripping, the cap 80 is provided with a plurality of axial grooves 84.

Another difference is that two set screws 28*a* and 28*b* are used to hold the wire rest 24 in place.

Finally, it should be noted that in this embodiment, the coil spring 62' has a plurality of turns. Sometimes better control of arrow flight is obtained by the added turns.

Operation

The archer's rest just described has been found to work best with bows cut at least 5/16ths inch or more pass center at the sight window (see FIG. 1). Fletching, feathers or vanes, should be straight or have about a two degree turn. Right hand shooters should turn two degrees right and left-hand shooters should turn two degrees left. With this set up, a release shooter should get total clearance.

Before doing anything else, the side hole 32 in the bow 29 should be cleaned by running a 5/16×24 tap through the hole. Next, the archer's rest 10 or 10' is screwed into the side wall hole 32 of the bow 29. The plunger 16 should be adjusted left or right (see arrow 92 in FIGS. 2A and 2B) so the arrow 99 is pointing straight ahead of the bow 29. The lock nut 22 (and, in the embodiment illustrated in FIGS. 2B, 7B and 8B, the end cap 80) should be githened with the fingers only. The set screw 28 (or 28*b*) at the arrow side of the plunger 16 is next loosened and the wire rest 24 is adjusted to have its free end 68 make contact at or about center or a little above center on the plunger ring 30. When this position is reached, the set screw 28 (or 28*b*) is tightened. When tightening the set screw 28 (or 28*b*) at the arrow side of the plunger, it has been found that it is best to hold on to the wire set 24 while tightening.

The wire rest 24 may have to be angled back slightly at the bottom on some bows. If necessary, the wire rest 24 can be bent slightly to fit the size of the arrow 99.

Next, the leather insert 74 (or 74') is temporarily attached to the open end of the sleeve 30. Afterwards, the two spring adjusting set screws 18 and 20 (or, for the embodiment illustrated in FIGS. 7B and 8B, the end cap 80 and/or set screw 83) on the opposite side of the arrow are adjusted to obtain the proper spring tension for arrow flight. Finally, the leather insert 74 (or 74') is fixed in place.

The archer's rest just described is particularly good for release shooters and works quite well for finger shooters. It has been found to give unexpectedly good performance when used in conjunction with light weight arrows. Satisfactory performance has been obtained with arrows having four fletchings or vanes, without damaging the vanes.

Having thus described the invention, it will be readily apparent to those skilled in the art that various alterations, improvements, modifications, and advantageous use made and observed with departing from the spirit and scope of the invention. For example, although the drawings show the first spring section 62 as having one or more coils or wraps, the diameter and thickness of the wire can be changed to change the spring effect. Similarly, base member 12 (or 12') need not be of cylindrical geometry and may be provided with a flat external surface to facilitate aligning the base member within the side wall 33 of the bow. Accordingly, it is intended that all such modifications, alterations, and improvements be covered hereby, and that the invention be limited only in accordance with the following claims.

I claim:

1. For an archer's bow, apparatus comprising:
(a) a base member having two opposite ends and an axial bore passing therethrough, said base member being adapted to be carried by the handle of the bow;
(b) a compressive spring located in said bore of said base member, said spring having at least one end which is located intermediate the ends of said bore;
(c) a plunger member slidingly captured in said bore of said base member and having one end positioned against said spring and an opposite free end extending out of one end of said base member;
(d) first adjusting means carried by said bore at the other end of said base member for adjusting the force exerted by said spring on said plunger;
(e) a reset made from one length of spring wire to form a straight section which is joined to a first spring section which is joined to a spacer section which is generally at right angles to said straight section and which is joined to a second spring section which has a free end which is adapted to support the shaft of an arrow; and
(f) second adjusting means carried by said plunger member for removably attaching said rest to said plunger member and for adjusting the separation of said free end of said second spring section from said free end of said plunger member.

2. The apparatus of claim 1, further including:
limiting means, carried by one of said members, for limiting the axial travel of said plunger member relative to said base member and for limiting the rotation of said straight section from a position which is generally perpendicular to the direction of travel of said arrow.

3. The apparatus of claim 2, wherein said base member has a slot which is located intermediate the ends of said base member and which extends from said axial bore to the exterior of the base member, and wherein said limiting means comprises a pin which is carried by said plunger and which extends into said slot for limiting the travel of said plunger in said bore, said pin not extending beyond said exterior of said base member.

4. The apparatus of claim 3, wherein said plunger has a threaded bore at each end and a slot at each end which enters said threaded bore; wherein said pin fits within the slot adjacent said one end of said plunger; and further including a threaded ember, which is carried in the threaded bore at said one end of said plunger and which gears against said pin, for holding said pin in place relative to said plunger.

5. The apparatus of claim 1, wherein said base member has a threaded exterior surface which is adapted to be mounted in to a hole found in the sidewall of the handle of the archer's bow, has two opposite ends which define an arrow side and the other side of said base member, and has an axial bore which passes from said arrow side to said other side and which has that end which is adjacent said other side threaded.

6. The apparatus of claim 5, wherein said base member includes a slot which extends from the interior of said axial bore to said exterior threaded surface.

7. The apparatus of claim 5, further including a first threaded member fitting into said threaded end of said axial bore for adjusting the force exerted by said spring on said plunger member.

8. The apparatus of claim 7, further including a second threaded member fitting into said threaded end of said axial bore for locking said first threaded member in position.

9. The apparatus of claim 1, wherein said plunger has at its free end a threaded bore which is open at one end and has a smooth bore which is located generally at right angles to said threaded bore of said plunger and which passes completely through said plunger.

10. The apparatus of claim 1, wherein said second spring section comprises a cantilevered arm which is generally in the same plane as said straight section and said spacer section and which has a free end which is in close proximity to said straight section.

11. The apparatus of claim 1, wherein said second spring section is bent in the form of a dog leg.

12. The apparatus of claim 1, wherein said first spring section is wound to permit said spacer section to move in a plane having a line which is generally perpendicular to said straight section.

13. The apparatus of claim 1, wherein said first spring section defines only one 360-degree generally circular wrap and wherein said wrap defines an axis of wrapping which is generally perpendicular to said straight section and the axis of said arrow.

14. The apparatus of claim 1, wherein said straight section has a flat side which is generally opposite said free end of said rest; and wherein said second adjustment means comprises a threaded member which is carried in a threaded bore at said free end of said plunger and which bears against said flat side of said straight section to removably attach said rest to said plunger and to adjust the separation of said free end of said rest from the free end of said plunger.

15. The apparatus of claim 1, further including means, carried by said free end of said plunger, for cushioning said arrow from said plunger.

16. The apparatus of claim 1, further including a relatively soft end ring which is located at the free end of said plunger and which is disposed between said arrow and said plunger.

17. The apparatus of claim 1, further including means, carried at said free end of said rest, for reducing the friction between said arrow and said rest.

18. For an archer's bow, apparatus comprising:

(a) a generally cylindrical base member having at least a portion of its exterior surface threaded for mounting in the hole found in the sidewall of the handle of the archer's bow, having two opposite ends which define an arrow side and the other side of said base member, having an axial bore which passes from said arrow side to said other side, and having a slot which has at least one end which is located intermediate the ends of said base member and which extends from said bore to the exterior surface of said base member;

(b) a compressive spring carried in said bore of said base member, said spring having at least one end located intermediate said ends of said base member;

(c) a plunger member slidingly disposed in said bore of said base member and having one end position against said spring and an opposite free end extending out of the arrow side of said base member, said plunger having at each end a threaded bore open to each end and having a smooth bore at each end which is located generally at right angles to said threaded bores of said plunger, at least one of said smooth bores passing completely through said plunger;

(d) a first threaded member carried by said other end of said base member for adjusting the force exerted by said spring on said plunger member;

(e) a compound spring rest comprising a single wire bent to form a straight section which passes through said smooth bore of said plunger and which is joined to a coil wound section which is joined to a straight spacer section which is generally at right angles to said straight section and which is joined to a cantilevered dog-leg section which is generally in the same plane as said straight section and said spacer section and which has a free end which is adapted to support the shaft of an arrow and which is in close proximity to said straight section, said coil section being bent to permit said spacer section to move in at least two directions, said straight section having a side which faces said dog-leg section;

(f) attaching means, carried in said threaded bore at said free end of said plunger bearing against a side of said straight section of said spring rest, for removably attaching said spring rest to said plunger and for adjusting the separation of the free end of said dog-leg section from the free end of said plunger;

(g) a pin which is carried by said plunger and which extends into said slot for limiting the travel of said plunger in said bore and for aligning said straight section of said wire rest in a direction which is generally parallel to the bow string of said bow, said pin not extending beyond the crest of the threads on said exterior of said base member; and (h) holding means, carried in the threaded bore at said one end of said plunger and bearing against said pin, for holding said pin in place relative to said plunger.

19. The apparatus of claim 18, wherein the threaded bores at either end of said plunger are in communication with each other; wherein said pin has the same diameter as said wire rest; wherein said smooth bores at each end of said plunger are generally parallel to each other.

20. The apparatus of claim 18, wherein said attaching means and said holding means are interchangeable.

21. The apparatus of claim 18, further including relatively soft means located at the free end of said plunger and relatively soft means at the free end of said rest for reducing the friction between said arrow and said rest.

22. The apparatus of claim 18, wherein said other end of said axial bore of said base member is threaded.

23. The apparatus of claim 22, wherein said first threaded member is carried within the threaded bore of said base member; and further including a second threaded member, fitting into said threaded end of said bore in said base member, for locking said first threaded member in position.

24. The apparatus of claim 18, wherein said first threaded member is carried on the threaded exterior surface of said base member.

25. For an archer's bow, apparatus comprising:

(a) a base member having two opposite ends and an axial bore, said base member being adapted to be carried by the sidewall of the bow;

(b) a plunger member slidingly captured in said bore of said base member and biased to have a free end extending out of one end of said base member;

(c) first adjusting means, carried by said base member, for adjusting the amount of bias applied to said plunger member;

(d) a rest made from one length of spring wire to form a relatively long straight section which is joined to a first spring section which is joined to a relatively short spacer section which is generally at right angles to said straight section and which is joined to a second spring section which has a free end which is adapted to support the shaft of an arrow;

(e) second adjusting means, carried by said plunger member, for removably attaching said rest to said plunger member and for adjusting the aspect of said free end of said rest relative to said free end of said plunger member; and (f) limiting means, carried by one of said members, for limiting the axial travel and rotation of said plunger member relative to said base member.

26. The apparatus of claim 25, wherein said straight section passes through a smooth bore in said plunger;

wherein said first spring is a coil spring which has one coil whose axis is generally at right angles to said straight section; and wherein said second spring section comprises a cantilevered dog-leg which is generally in the same plane as said straight section and said spacer section and which has a free end and is in close proximity to said straight section, said coil spring being wound to permit said spacer section to move in at least two mutually perpendicular planes.

27. The apparatus of claim 25, wherein said limiting means comprises:

(a) a lock nut, carried by said base member and barring against said side wall, for setting the angular position of said base member relative to said bows;

(b) a axial slot in one of said members; and (c) a pin, carried by the other of said members and fitting in said slot.

* * * * *